US008099930B2

(12) United States Patent
Moessnang

(10) Patent No.: US 8,099,930 B2
(45) Date of Patent: Jan. 24, 2012

(54) DEVICE AND METHOD FOR POSITIONING OF NOZZLES

(75) Inventor: Konrad Moessnang, Mindelaltheim (DE)

(73) Assignee: Multivac Sepp Haggenmueller GmbH & Co. KG (DE)

( * ) Notice: Subject to any disclaimer, the term of this patent is extended or adjusted under 35 U.S.C. 154(b) by 276 days.

(21) Appl. No.: 12/380,283

(22) Filed: Feb. 25, 2009

(65) Prior Publication Data

US 2009/0217625 A1 Sep. 3, 2009

(30) Foreign Application Priority Data

Feb. 25, 2008 (DE) ..... 10 2008 011 019

(51) Int. Cl.
*B65B 31/06* (2006.01)

(52) U.S. Cl. ..... 53/434; 53/459; 53/512; 53/570

(58) Field of Classification Search ..... 53/405, 53/408, 434, 459, 512, 79, 86, 570, 385.1; *B65B 31/06*
See application file for complete search history.

(56) References Cited

U.S. PATENT DOCUMENTS

| | | | | |
|---|---|---|---|---|
| 2,858,655 | A | 11/1958 | Mahaffy et al. | |
| 2,963,838 | A * | 12/1960 | Harrison et al. | 53/512 |
| 3,182,432 | A | 5/1965 | Canfield | |
| 4,221,101 | A * | 9/1980 | Woods | 53/512 |
| 4,779,398 | A * | 10/1988 | Glandon et al. | 53/434 |
| 4,860,523 | A * | 8/1989 | Teteishi et al. | 53/512 |
| 5,737,906 | A * | 4/1998 | Ishimaru | 53/512 |
| 2002/0043050 | A1 | 4/2002 | Costello et al. | |
| 2002/0157353 | A1 * | 10/2002 | Smithson et al. | 53/434 |
| 2003/0054072 | A1 | 3/2003 | Merriman et al. | |
| 2004/0168404 | A1 * | 9/2004 | Knowlton et al. | 53/434 |
| 2005/0178090 | A1 * | 8/2005 | Koke et al. | 53/434 |
| 2008/0022637 | A1 | 1/2008 | Buchko et al. | |

FOREIGN PATENT DOCUMENTS

| | | | |
|---|---|---|---|
| DE | 3335001 | A1 * | 5/1984 |
| EP | 0 309 132 | | 3/1989 |
| EP | 734951 | A2 * | 10/1996 |
| JP | 04-044925 | | 2/1992 |
| JP | 2006240644 | A * | 9/2006 |
| WO | WO-99/48758 | | 9/1999 |
| WO | WO 03024804 | A1 * | 3/2003 |

OTHER PUBLICATIONS

Machine translation of JP 2006240644 A, from http://www4.ipdl.inpit.go.jp/Tokujitu/tjsogodbenk.ipdl, 13 pages, retrieved Jan. 6, 2011.*

* cited by examiner

*Primary Examiner* — Stephen F Gerrity
(74) *Attorney, Agent, or Firm* — Brooks Kushman P.C.

(57) ABSTRACT

An inventive device or a method, respectively, for a chamber machine for positioning at least a nozzle (11) and/or a measuring device relative with respect to a bag (9) having a bag mouth should solve the object to simplify or to accelerate, respectively, gassing the bags with protective gas or the injection of liquids or solids, respectively. The inventive device comprises a movable holding device (15) at which the nozzle (11) and/or the measuring device is fixable and which is at least movable between a rest position and an operation position. The holding device (15) positions the nozzle (11) and/or the measuring device in its rest position outside the bag mouth and positions the same in its operation position so that it projects into the bag mouth.

6 Claims, 5 Drawing Sheets

DEVICE AND METHOD FOR POSITIONING OF NOZZLES

The present invention refers to a device and a method for positioning of nozzles, in particular for use in chamber machines.

For packaged goods, the packaging is flooded for different reasons with a protective atmosphere after evacuating. Thereafter the packaging is air tightly sealed. If the product is packaged in a bag gas nozzles are necessary for gassing in the interior of a bag since the bag otherwise collapses by the pressure of the in flowing protective gas and therefore gassing from the exterior of the bag is not possible anymore. In order to do so the bag neck of the bag is pulled by hand over one or more gas nozzles in order to flood the interior of the bag with gas. In conventional machines the bag filled with a product is automatically supplied into a vacuum chamber and the chamber automatically closes, however, the bag neck has to be pulled manually over the gas nozzles before closing the chamber. This makes necessary personal, time and increases cost.

The object of the present invention is to provide a device and a method, respectively, which removes the above mentioned disadvantages and simplifies and accelerates, respectively, the gassing of bags with a protective gas or the injection of liquid or solid. Preferably a high operation safety should be secured.

Using the inventive device or the inventive method, respectively, gassing and injection, respectively, of liquid and solid can be simplified and accelerated. By the automatisation cost is reduced and an identical reproducability is obtained which is impossible by adjusting the bag over the gas, liquid or solid nozzles by hand, whereby a high operation safety is obtained. Furthermore, in this manner a hygienic operation process is obtained in the seal region, e. g. in injection of brine or oil since the nozzles always can be brought into the bag sufficiently far.

Figure 1:
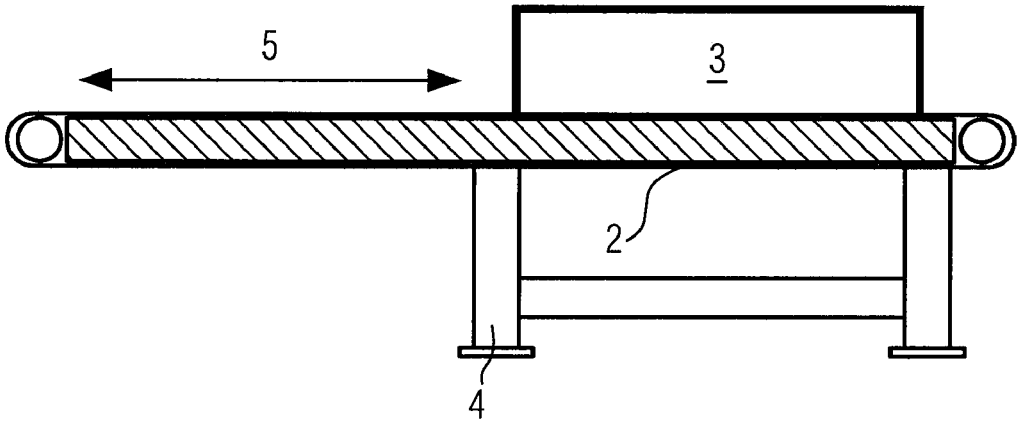
Figure 2:
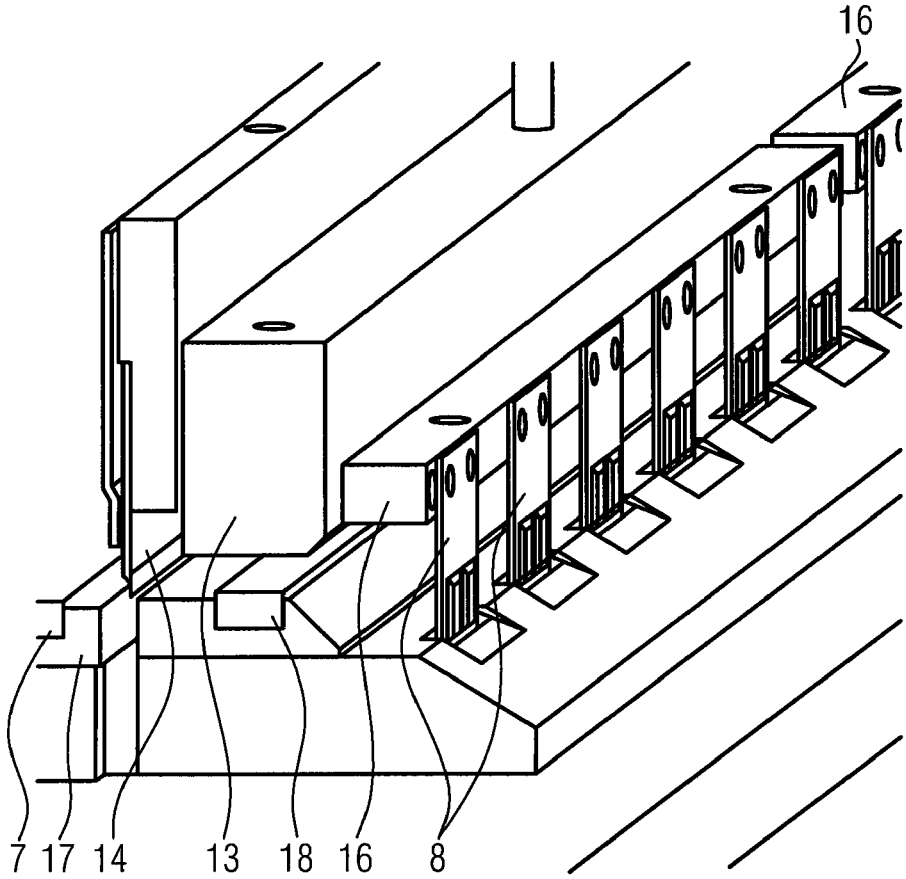
Figure 3:
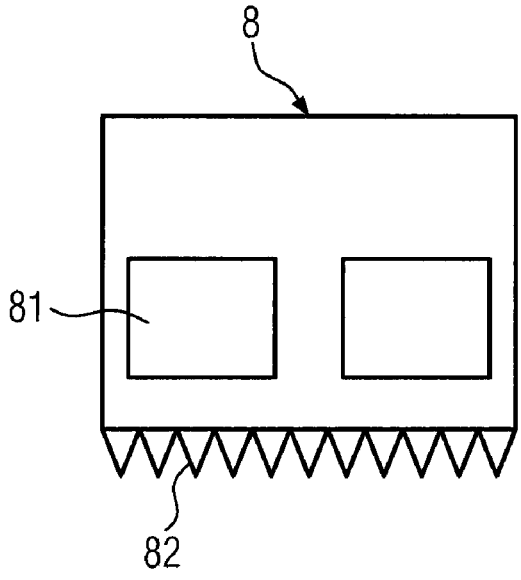
Figure 4A:
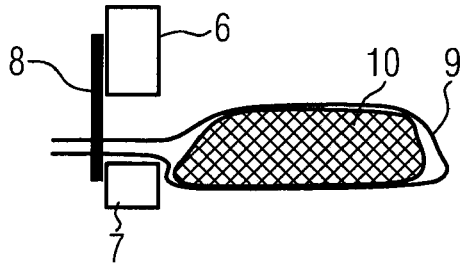
Figure 4B:
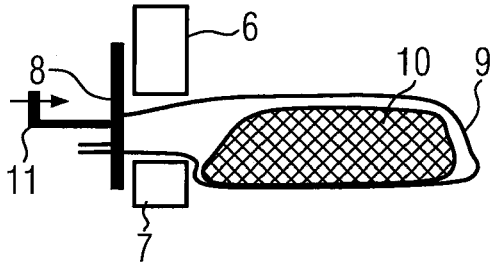
Figure 4C:
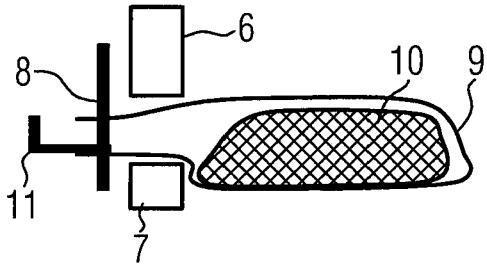
Figure 4D:
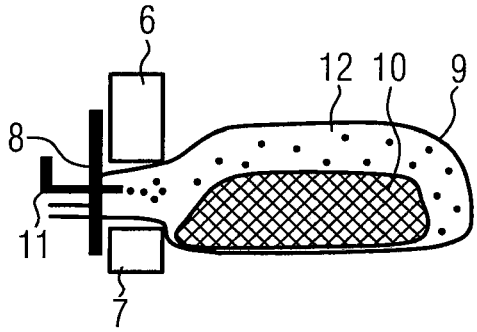
Figure 4E:
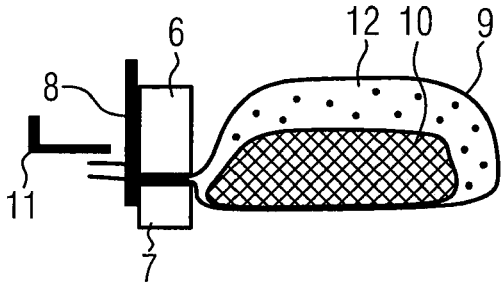
Figure 4F:
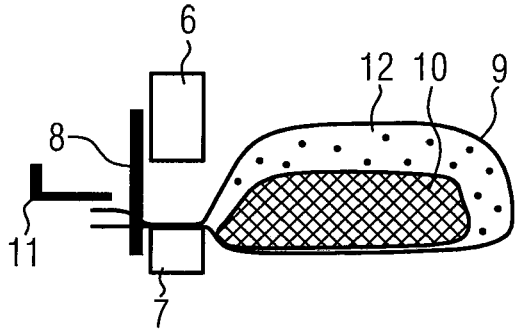
Figure 5A:
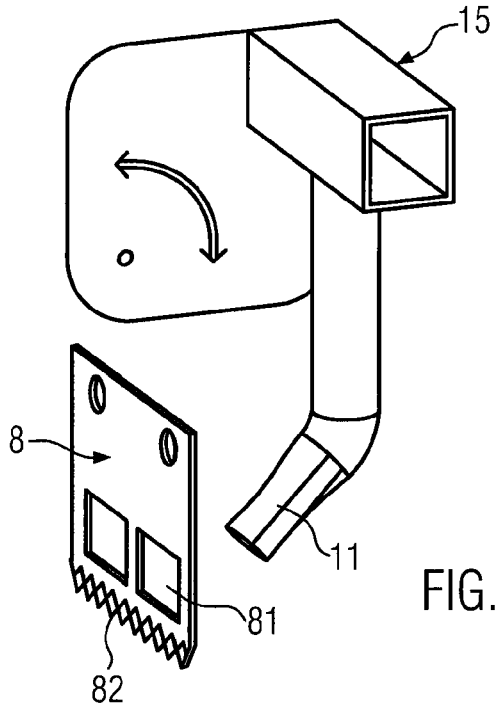
Figure 5B:
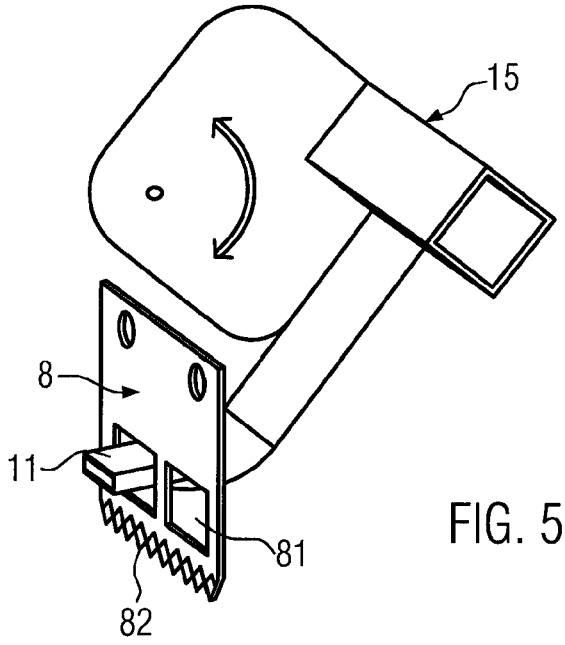

Further features and advantages of the invention follow from the description of embodiments based on the enclosed drawings. From the figures show:

FIG. 1 a schematic total view of a chamber machine;

FIG. 2 a perspective partial view of a chamber machine;

FIG. 3 a schematic partial view of a knife from the front;

FIG. 4*a*.)-*f*.) schematic views of the device for evacuating, gassing and injection, respectively, and sealing;

FIG. 5*a* a perspective view of a device for positioning a nozzle in rest position;

FIG. 5*b* a perspective view of a device for positioning a nozzle in operation position.

In the following with reference to the figures a first embodiment of the present invention is described exemplarily with a chamber machine. In the present embodiment the chamber machine is formed as an automatic chamber belt machine.

FIG. 1 shows a schematic view of a chamber machine 1 having a conveyor belt 2, a chamber 3, a rack 4, and a placing region 5. The chamber 3 is formed by a lid which opens automatically being driven by a motor in order to accommodate bags 9 (see FIG. 4) which are supplied automatically by the conveyor belt 2 and which automatically closes thereafter in order to form the chamber 3.

FIG. 2 shows the part of the chamber machine 1 relevant for the invention. A plurality of knives 8, a pressure bar 13, a bottom rail 18, a cut-off knife 14, a knife holder 16, a sealing rail accommodation 17 and both sealing rails 6 (see FIG. 4) and 7 are shown. In FIG. 2 six knives 8 are fixed to the knife holder 16, a further knife holder 16 with knives 8 is indicated. The knife holders 16 are fixed to the pressure bar 13 and are moved vertically therewith. The bottom rail 18 forms a limit for the vertical motion of the pressure bar 13. In this manner the motion of the knife 8 is limited and an end position is defined. Thus it is ensured that the knives 8 do not abut against a hard surface and get dull with time. The mouth of the bag 9 would show to the right in this illustration. Contrary thereto the mouth of the bag 9 shows to the left in FIG. 4.

In the operation the cut-off knife 14 cuts off the bag 9 after the sealing, in this illustration at the right beside the second sealing rail 7 or the sealing rail accommodation 17, respectively. The filled and sealed bag 9 can be taken out by hand or automatically transported away as well as the part 8 of the bag 9 perforated by the knife.

FIG. 3 shows an essentially rectangular knife in the front view with two apertures 81 which also have rectangular shapes and are arranged in the lower half of the knife 8. At the lower side a blade 82 is provided for slicing a foil. The blade 82 is formed by a plurality of teeth similar to a saw.

FIG. 4*a-f* shows in six steps the inventive method or the operational mode of the device. In the figures always an upper first sealing rail 6, a lower second sealing rail 7, a knife 8 and a bag 9 with a product contained therein are shown. The bag 9 comprises its mouth in the left part of each of the figures. The total structure is provided in the chamber 3 of the chamber machine 1 during operation. In the following shows:

a.) How the knife 8 has penetrated the bag 9. The first sealing rail 6 is provided in its rest position.

b.) A nozzle 11 which is moved by means of a not shown holding device in the direction of the bag opening. The arrow shows the direction of motion. At the same time the chamber 3 is evacuated. Since the air escapes from the interior of the bag slower than the air in the chamber 3, the bag 9 swells. After or during, respectively, evacuating the lower foil layer of the bag 9 is just above the blade 82 (see FIG. 2) of the knife 8, and the upper foil layer of the bag 9 is shifted by the out flowing air beyond the apertures 81 (see FIG. 2) of the knife 8.

c.) How the nozzle 11 is pivoted and/or pushed through the aperture 82 of the knife 8 into the swelled bag 9. FIG. 3*c*.) shows the operation position of the nozzle 11.

d.) The gassing and the injection process, respectively, of a liquid and/or a solid. The reference sign 12 designates generally an additive as for example protective gas, oil or conservation agent.

e.) The sealing process wherein the upper first sealing rail 6 moves from its rest position downward and pinches together with the lower second sealing rail 7, the bag 9 and seals the bag 9 by application of heat. Before the sealing process the nozzles 11 is pivoted or shifted into its rest position.

f.) How the upper first sealing rail returns again into its rest position and the bag 9 is sealed.

FIGS. 5*a* and *b* show possible embodiments of a holding device 15 for the nozzle 11. The holding device is constructed essentially of a quadratic plate onto which a squared tube is fixed which extends in FIG. 5 in the right upper corner of the plate vertically to the plane of the drawing. At this squared tube a tube is mounted which extends downward. At the end of this tube the nozzle 11 is fixed in an angle of about 45°. FIG. 5*a* shows this device in the rest position, FIG. 5*b* shows it in the operation position. The nozzle 11 is pivoted through the aperture 81 of the knife 8 in this embodiment. The knife 8 does not change its position during this process. It is fixed in place.

The present invention is not limited to one knife or one nozzle, respectively. As is shown also in FIG. 2 a plurality of knives and nozzles can be provided. A plurality of nozzles can be inserted into the bag as well as a plurality of bags may also be filled and sealed with a product additive simultaneously. Depending on the size of the machine, for example two or more bags may be carried into the chamber 3. In the above described manner the bags are gassed or provided with a product additive and thereafter they are sealed commonly by two long sealing rails or by a plurality of sealing rail pairs restricted to the region of the bag. Cut-off can be realized also by a long continuous knife or by a plurality of knives limited to the region of the bag.

It is also conceivable to replace the knives by another opening auxiliary device for the bag. For example a spreading device may be provided which opens the bag neck and makes it possible for the nozzles to be pivoted or shifted, respectively, into the bag. Preferably knives are to be used since the knives can be operated independently from the bag necks protruding into the machine. In order to obtain reproducability and system security it is preferred to provide at least one opening auxiliary device for the bags.

In the packaging of sensitive or highly sterile products often an exact adjusting of the temperature and/or air humidity is important. The measurement within the evacuation chamber is unprecise since the values deviate from those in the bags. Therefore it is conceivable instead of the nozzles to insert other devices as for example moisture-meter or thermometer by means of the holding device into the bag. Therefore products can be recognized which boil during evacuation.

By means of the nozzles a liquid material, a gaseous material or a powder material, a product additive (e. g. brine, separation agent) or a protective agent for conservation (for example oil for ball bearings) can be inserted. Other product additives are conceivable.

Positioning of the nozzles by means of the holding device can be realized mechanically by a pivot device or a shift device.

The present invention is not limited to employment in chamber machines. An employment is conceivable for all types of machines wherein gassed or liquids or solid or measuring sensors are to be inserted.

The invention claimed is:

1. A device for a chamber machine for positioning at least a nozzle and/or a measuring device relative to a bag having a bag mouth, the device for a chamber machine comprising a movable holder, at which the nozzle and/or the measuring device is fixable and which is movable at least between a rest position and an operation position for moving the nozzle and/or the measuring device between a rest position and an operation position, wherein the holder positions the nozzle and/or the measuring device in its rest position outside of the bag and positions the nozzle and/or the measuring device in its operation position so that the nozzle and/or the measuring device projects into the bag; and at least an auxiliary opener which is movable at least between a rest position and an operation position for forming an opening in the bag that receives the nozzle and/or measuring device, wherein the auxiliary opener comprises a knife having a blade and at least an aperture, and wherein the nozzle and/or the measuring device is provided in its rest position outside the aperture and at its operation position projects into the aperture.

2. The device according to claim 1, wherein the knife comprises two apertures.

3. A method for positioning of a nozzle and/or measuring device in a chamber machine, the method comprising:

providing a chamber machine comprising a chamber and a movable holder, at which a nozzle and/or a measuring device is fixable and which is movable at least between a rest position and an operation position for moving the nozzle and/or the measuring device between a rest position and an operation position;

moving the holder from the rest position into the operation position to position the nozzle and/or measuring device into its operation position so that it projects into a bag; and moving an auxiliary opener from a rest position into an operation position to form an opening in the bag that receives the nozzle and/or measuring device;

wherein the auxiliary opener comprises a knife having at least an aperture and a blade, and the knife slices the bag to form the opening when the auxiliary opener is moved from the rest position into the operation position, and wherein the nozzle and/or the measuring device is disposed in its respective rest position outside the aperture and in its operation position projects into the aperture.

4. The method according to claim 3, further comprising:

evacuating the chamber, inserting an additive through the nozzle when the nozzle projects through the aperture of the knife into the bag.

5. The method according to claim 4, further comprising swelling the bag, and arranging a lower foil layer of the bag above the blade and/or arranging an upper foil layer of the bag above the aperture.

6. A chamber machine comprising a device according to claim 1, and a lid that is closeable to at least partially define a chamber that receives the device.

* * * * *